United States Patent [19]

Kirayoglu

[11] Patent Number: 4,556,601

[45] Date of Patent: Dec. 3, 1985

[54] HEAVY-WEIGHT NONWOVEN FABRIC OF HYDRAULICALLY-ENTANGLED FIBERS

[75] Inventor: Birol Kirayoglu, Wilmington, Del.

[73] Assignee: E. I. Du Pont de Nemours and Company, Wilmington, Del.

[21] Appl. No.: 568,174

[22] Filed: Jan. 5, 1984

[51] Int. Cl.[4] ..... D04H 1/00

[52] U.S. Cl. ..... 428/219; 28/104; 428/280; 428/339; 428/902

[58] Field of Search ..... 28/104; 428/219, 280, 428/339, 359

[56] References Cited

U.S. PATENT DOCUMENTS

| | | | |
|---|---|---|---|
| 3,449,809 | 7/1969 | Shin | 28/104 |
| 3,485,706 | 12/1969 | Evans . | |
| 3,486,168 | 12/1969 | Evans et al. . | |
| 3,493,462 | 2/1970 | Bunting et al. . | |
| 3,508,308 | 4/1970 | Bunting et al. | 28/104 |
| 3,560,326 | 2/1971 | Bunting et al. . | |
| 4,188,690 | 2/1980 | Suzuki et al. | 28/104 |
| 4,251,587 | 2/1981 | Mimura et al. | 28/104 |
| 4,410,579 | 10/1983 | Johns | 28/104 |
| 4,426,420 | 1/1984 | Likhyoui | 28/104 |

OTHER PUBLICATIONS

"Spunlaced Nomex® Aramid Nonwoven Sheet Structure", Research Disclosure, 12410 (Aug. 1974).

*Primary Examiner*—James C. Cannon

[57] ABSTRACT

An improved heavy-weight, nonapertured, nonwoven fabric of hydraulically entangled synthetic organic staple fibers has a unit weight of 200 to 850 g/m$^2$ [6 to 25 oz/yd$^2$], a strip tensile strength of at least 0.26 (N/cm)/(g/m$^2$) [5 (lb/in)/(oz/yd$^2$)] and a resistance to disentanglement of at least 50 alternate extension cycles. The fabric is much stronger than such prior art heavy-weight nonwoven fabrics of hydraulically entangled staple fibers.

6 Claims, 1 Drawing Figure

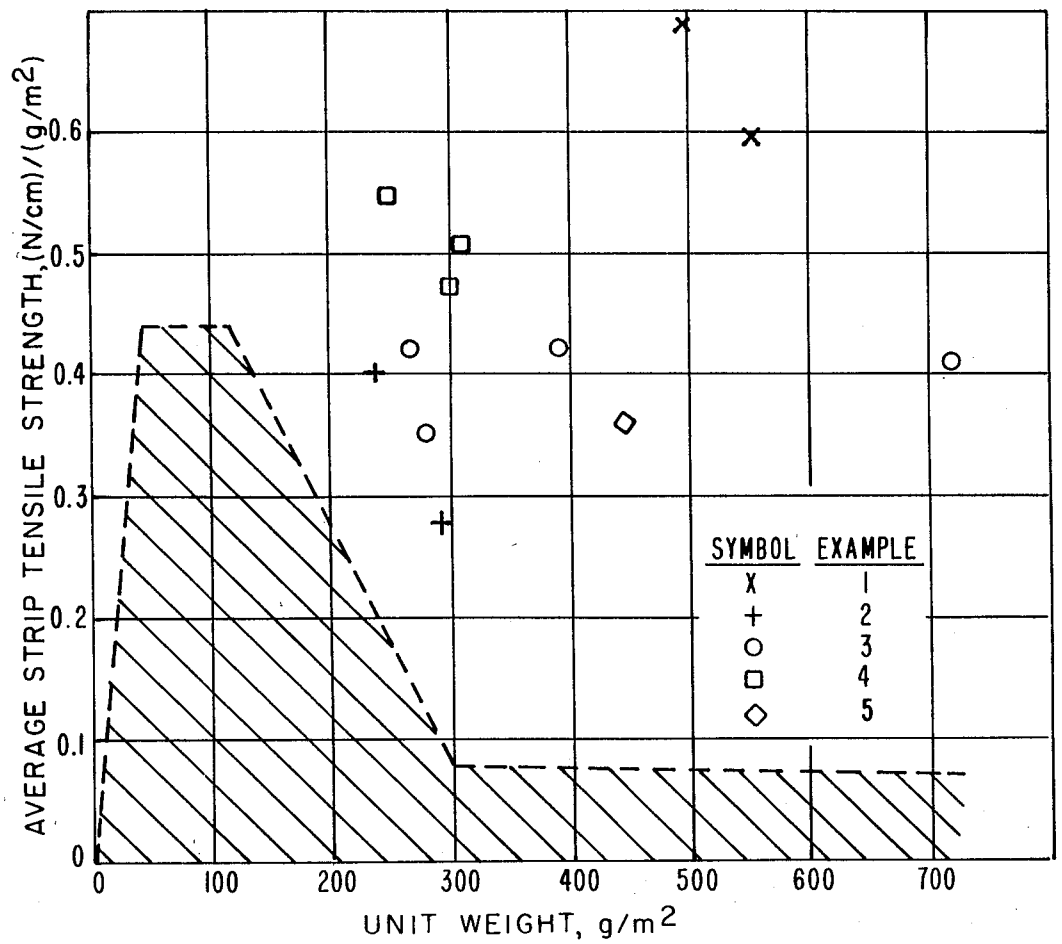
SYMBOL EXAMPLE
X 1
+ 2
○ 3
□ 4
◇ 5
AVERAGE STRIP TENSILE STRENGTH, (N/cm)/(g/m2)
0
0.1
0.2
0.3
0.4
0.5
0.6
UNIT WEIGHT, g/m2
0
100
200
300
400
500
600
700

HEAVY-WEIGHT NONWOVEN FABRIC OF HYDRAULICALLY-ENTANGLED FIBERS

BACKGROUND OF THE INVENTION

1. Field of the Invention

This invention relates to nonapertured, heavy-weight nonwoven fabric made from hydraulically entangled staple fibers of synthetic organic polymer. More particularly, the invention concerns such a fabric having unusually strong tensile characteristics and high resistance to disentanglement.

2. Description of the Prior Art

Nonwoven fabrics, in which hydraulically entangled staple fibers of synthetic organic polymer form a stable, nonapertured fabric without the presence of resin binder of fiber-to-fiber melt bonds are known in the art. Such fabrics have been manufactured commercially with unit weights that are usually less than 4 oz/yd$^2$ [136 g/m$^2$]. Bunting et al, U.S. Pat. Nos. 3,493,462, 3,508,308 and 3,560,326 disclose a wide variety of such fabrics with unit weights as high as about 20 oz/yd$^2$ [680 g/m$^2$]. The commercially manufactured nonapertured fabrics of hydraulically entangled staple fibers are strong and exhibit strip tensile strengths of as high as about 8.5 (lb/in)/(oz/yd$^2$) [0.44 (N/cm)/(g/m$^2$)]. However, the heavy-weight fabrics of this type which were disclosed by Bunting et al were relatively weak. For example, such heavy-weight fabrics had strip tensile strengths of 4.39 (lb/in)/(oz/yd$^2$) [0.226 (N/cm)/(g/m$^2$)] at a weight of 6.7 oz/yd$^2$ [227 g/m$^2$] and 1.3 and 1.1 (lb/in)/(oz/yd$^2$) [0.067 and 0.059 (N/cm)/(g/m$^2$)] for weights of 10 and 20 oz/yd$^2$ [339 and 678 g/m$^2$], respectively.

To strengthen these hydraulically entangled staple fiber nonwoven fabrics, various approaches have been made. These included incorporating in the fabrics very long (e.g., 6 inch [15.24 cm]) fibers, fibers of special cross-section, substantially continuous filaments, scrims, layers of continuous filament webs, or specially designed layers. Process modifications intended to provide the increase in strength included treating the staple fiber starting web with hydraulic jets first with the web moving in one direction and then with the web moving in a direction perpendicular to the first direction, adding special chemical agents to the hydraulic jets, utilizing special supports or grills on which the webs were hydraulically treated, and starting with special yarns. Generally, each of these strength increasing modifications were useful for lighter weight fabrics. However, these modifications generally were not satisfactory for preparing strong, heavy weight, nonapertured nonwoven fabrics, which consisted essentially of hydraulically entangled staple fibers of synthetic organic polymer. Such strong, heavy-weight fabrics are desired in uses such as heavy-duty gas filtration. The purpose of this invention is to provide such a strong nonapertured, heavy-weight nonwoven fabric.

SUMMARY OF THE INVENTION

The present invention provides an improved heavy-weight, nonapertured nonwoven fabric which consists essentially of hydraulically entangled staple fibers of synthetic organic polymer. The improvement comprises the fabric having in combination a unit weight in the range of 200 to 850 g/m$^2$ [6–25 oz/yd$^2$], a grab strength of at least 160 N/cm [91 lb/in], a strip tensile strength of at least 0.26 (n/cm)/(g/m$^2$) [5 (lb/in)/(oz/yd$^2$)] and a resistance to disentanglement of at least 50 alternate extension cycles. Preferably, the fabric combines a unit weight in the range of 240 to 510 g/m$^2$ [7–15 oz/yd$^2$], a grab strength in the range of 245 to 875 N/cm [140–500 lb/in], a strip tensile strength in the range of 0.36 to 0.77 (N/cm)/(g/m$^2$) [7–15 (lb/in)/(oz/yd$^2$)] and a resistance to distenglement of at least 90 alternate extension cycles. Usually, the preferred fabrics have 3 to 10 jet tracks per centimeter [7.5–25 per inch]. The preferred staple fibers are of 1 to 18 dtex [0.9–16 den] and of 0.6 to 5 cm [$\frac{1}{4}$ to 2 inch] length. Preferred polymers for the staple fibers are poly(p-phenylene terephthalamide), poly(m-phenylene isophthalamide) or poly(ethylene terephthalate).

BRIEF DESCRIPTION OF THE DRAWING

The invention will be understood more readily by reference to the drawing which is a graph of strip tensile strength versus unit weight that compares the fabrics of the present invention with those of the prior art.

DETAILED DESCRIPTION OF PREFERRED EMBODIMENTS

As used herein, the term "heavy-weight" means a nonapertured nonwoven fabric of hydraulically entangled staple fibers that has a unit weight in the range of 200 to 850 g/m$^2$ [6–25 oz/yd$^2$].

The key advantageous distinction of the products of the present invention is illustrated in the graph of the attached drawing. The shaded area represents the nonapertured nonwoven fabrics of hydraulically entangled staple fibers of the prior art. The individual points shown on the graph represent the strip tensile data given in detail hereinafter in the Examples. Note the extraordinarily higher tensile strengths of the heavy-weight fabrics of the invention. These strong fabrics of the invention also possess excellent grab strengths and resistance to disentanglement.

Generally the staple fibers which are suitable for use in the nonapertured nonwoven fabrics of the present invention are in the range of 1 to 18 dtex [0.9 to 16 denier] and in the range of 0.6 to 5 cm [$\frac{1}{4}$–2 ] inches long. Preferably, the dtex range is 1.4 to 2.5 dtex [1.25–2.25 denier] and the length range 1.3 to 3.8 cm [$\frac{1}{2}$–1$\frac{1}{2}$ inches]. Fibers of circular cross-section are preferred.

The staple fibers may be of any synthetic organic polymer. Preferred polymers include poly(p-phenylene terephthalamide), poly(m-phenylene isophthalamide) and poly(ethylene terephthalate). Fabrics made of hydraulically entangled fibers of each of the polymers are illustrated in the Examples.

The heavy-weight nonapertured nonwoven fabric of the present invention possesses a unique advantageous combination of characteristics, which includes a grab strength of at least 160 N/cm [91 lb/in], preferably in the range of 245 to 875 N/cm [140 to 500 lb/in], a strip tensile strength of at least 0.26 (N/cm)/(g/m$^2$) [5 (lb/in)/(oz/yd$^2$)], preferably in the range of 0.36 to 0.77 (N/cm)/(g/m$^2$) [7–15 (lb/in)/(oz/yd$^2$)] and the resistance to disentanglement is at least 50 alternate extension cycles, preferably at least 90 cycles.

The preferred manner in which the hydraulic entanglement treatment is performed in manufacturing the preferred fabrics of the present invention results in the nonapertured fabrics having a repeating pattern of closely spaced lines of fiber entanglement, called "jet tracks." The jet tracks are readily visible under low magnification. The preferred fabrics of the invention have between 3 and 10 jet tracks per cm [7.5 to 25 per inch] and most preferably between 3 and 6 jet tracks per cm [7.5 to 15 per inch].

In making the nonapertured nonwoven fabrics of the present invention, the staple fibers are formed into starting batts of 200 to 850 g/m$^2$ [6 to 25 oz/yd$^2$] by known techniques which employ Rando-webbers or air-lay-down equipment such as that disclosed in Zafiroglu, U.S. Pat. No. 3,797,074. A continuous hydraulic entanglement treatment is then performed with the staple-fiber starting batt in place on a foraminous support, such as a woven wire screen.

In the hydraulic entanglement treatment, the batt is exposed to a series of fine, columnar stream of water supplied to one surface of the batt and then to the other surface of the batt. The streams of water are supplied from a row of orifices located a short distance, usually about 2.5 cm [1 inch] above the surface of the batt. Orifices of the type disclosed in Dworjanyn, U.S. Pat. No. 3,403,862, are employed. Preferred orifices have a diameter in the range of 0.13 to 0.22 mm [0.005 to 0.009 inch]. In the preferred process of the present invention the orifices are spaced to produce at least 3 jet tracks per cm [7.5 per inch] and no more than 10 jet tracks per cm [25 per inch], and most preferably no more than 5 jet tracks per cm [12.7 per inch].

In the preferred hydraulic treatment portions of the staple fibers initially located at one surface of the batt are driven by the water jets through the thickness of the batt to the opposite surface of the batt. This important rearrangement of the fibers is performed immediately after an initial wetting and preliminary light consolidation of the batt. If the starting batt has sufficient coherency as supplied to the entanglement step, the very first row of water streams can perform this important rearrangement, if supplied at sufficient pressure and if they impact the batt with sufficient force. The use of such jets on wide spacings (i.e., no more than 10/cm) results in deeper penetration of the streams into the batt with less interference from adjacent streams than would be obtained with closer spaced jets. Furthermore, it is preferred that, in contrast to the commonly used commercial practice of gradually increasing the supply pressures of the streams in each successive row of jets, the highest pressures be supplied to the first row of jets (or the first row after the initial wetting operation). Preferably, the pressure to this first row of jets is in the range of 6890 kPa to 22740 kPa [1000–3300 psi]. This prevents the fibers at the surface of the batt from immediately forming a dense, tightly entangled surface layer, which then resists water-jet penetration and does not allow portions of fibers from one surface of the batt to be forced through the thickness of the batt to the opposite surface. Once the initial desired rearrangement has been performed, the remainder of the entanglement process can be performed in the known manner. Even if closer spaced jets are used in the remaining portion of the hydraulic entanglement procedure, the jet tracks produced by the initial high impact jets are not erased or obscured. The preferred hydraulic-jet treatment just described in comparison to the other methods illustrated herein is believed to result in stronger, better entangled and more delamination-resistant heavy-weight nonwoven fabrics.

Staple fiber blends of mixed lengths and/or mixed decitex usually are more readily made into fabrics of the invention than fibers of substantially only one length and decitex. Thus, blends of staple fibers may be formed into fabrics of the invention with less total expenditure of energy per unit weight of fabric, with less total energy impact product, and with lower maximum jet pressures. Heavier, longer and stiffer fibers are more difficult to rearrange and entangle.

The following test procedures were used to measure the various characteristics and properties reported herein. All measurements were made on dry fabrics or fiber.

Tensile properties are measured on an Instron tester at 70° F. and 65% relative humidity.

Strip tensile strength is measured in general accordance with ASTM Method D-828-60 on a ½ inch [1.27 cm] wide by 4 inch [10.16 cm] long sample, using a 2 inch [5.08 cm] gauge length and an elongation rate of 50% per minute.

Grab strength is measured in general accordance with ASTM Method D-1682-64, on a 4 inch [10.16 cm] wide by 6 inch [15.24 cm] long sample, using a 3 inch [7.62 cm] gauge length and an elongation rate of 25% per minute.

For each of the tensile measurements, samples were cut in the machine direction (MD) and the cross-machine direction (XD) of the fabric. In the graph of the attached drawing, only the averages of MD and XD values are plotted.

Disentanglement resistance of nonapertured nonwoven fabric was measured in cycles by the Alternate Extension Test described by Johns & Auspos, "The Measurement of the Resistance to Disentanglement of Spunlaced Fabrics," Symposium Papers, Technical Symposium, *Nonwovens Technology—Its Impact on the 80's*, INDA, New Orleans, La., 158–162 (March 1979). The load applied to the test sample in the machine direction of the fabric (i.e., the vertical load on the tester) in grams was the unit weight in g/m$^2$ multiplied by 2.95. The load applied in the cross-machine direction was one-half that applied in the machine direction.

In the examples which follow batts of staple fibers are given a hydraulic jet treatment to form strong, heavy-weight fabrics of the invention. Different sets of orifices are employed to provide columnar streams of water to the batts, while the batts are supported on screens, under which means are provided for removing the water. The orifices are arranged in rows perpendicular to the direction of batt travel and are located about 1 inch (2.5 cm) from the surface of the batt. Five sets of orifices and five different screens are employed. These orifice sets are described as follows:

| Orifice Set | Orifice Diameter inch [mm] | Number per inch [cm] |
|---|---|---|
| A | 0.007 [0.178] | 5 [2.0] |
| B | 0.007 [0.178] | 10 [3.9] |
| C | 0.007 [0.178] | 20 [7.9] |
| D | 0.005 [0.127] | 40 [15.7] |
| E | 0.005 [0.127] | 20 [7.9] |

Note that in orifice set A, B, C and E, all the orifices are located in a single row, but in set D the orifices are arranged in two staggered rows spaced 0.04 inch [0.10 cm] apart with each row containing 20 orifices/inch [7.9/cm].

The different wire mesh support screens that are employed in the examples are described as follows:

| Screen | Wires per inch [cm] | % Open Area |
|---|---|---|
| A | 100 × 96 [39.3 × 37.8] | 21 |
| B | 75 × 58 [29.5 × 22.8] | 21 |
| C | 40 × 36 [15.7 × 14.2] | 36 |
| D | 20 × 20 [7.9 × 7.9] | 41 |
| E | 50 × 50 [19.7 × 19.7] | 50 |

EXAMPLE 1

This example illustrates the invention with heavy-weight, nonapertured, jet-tracked nonwoven fabrics of hydraulically entangled staple fibers of poly(p-phenylene terephthalamide). The fabrics have outstanding tensile characteristics.

Two batts of poly(p-phenylene terephthalamide) staple fibers were prepared. Each batt consisted of three layers of webs that were formed on a Rando-webber air laydown machine from ¾ inch [1.9 cm] long and 1.5 denier [1.7 dtex] T-29 Kevlar® aramid fibers. The fibers were commercially available from E. I. Du Pont de Nemours and Company. Batt 1-a weighed 14.7 oz/yd$^2$ [498 g/m$^2$] and Batt 1-b weighed 16.4 oz/yd$^2$ [556 g/m$^2$]. Each batt was then placed on Screen C and forwarded at a speed of 10 yards per minute [9.14 meters/min] under rows of columnar jets of water supplied for orifice sets C. Supply pressure to successive rows of jets, was 500 psi [3450 kPa] to the first row of jets followed by 3,300 psi [22,740 kPa] to each of the next three rows of jets. The same sequence of jet treatments was then given through the opposite surface of the batt.

Table I lists the total energy-impact product (ExI) and the total energy expended in the hydraulic jet treatment along with properties of the resultant nonapertured fabric. The average of the MD and XD strip tensile strengths of the fabrics are plotted in the FIGURE and show the extraordinarily higher strip tensile strength of these fabrics of the invention, as compared to the highest strip tensile strength exhibited by same weight of prior art fabrics. The fabrics of this example have strip tensile strengths that are about 7.7 to 9.2 times those of the prior art fabrics of comparable weight.

TABLE I

| | Fabrics of Example 1 | |
|---|---|---|
| | Batt 1-a | Batt 1-b |
| Unit weight | | |
| oz/yd$^2$ | 14.7 | 16.4 |
| [gm/m$^2$] | [498] | [556] |
| Energy-Impact Product | | |
| Hp-hr lb$_f$/lb$_m$ | 0.123 | 0.110 |
| [10$^6$ JN/kg] | [3.23] | [2.89] |
| Energy | | |
| Hp-hr/lb$_m$ | 0.76 | 0.68 |
| [10$^6$ J/kg] | [4.48] | [4.01] |
| Grab Strength | | |
| MD, lb/in | 334 | 357 |
| [N/cm] | [584] | [624] |
| XD, lb/in | 492 | 500 |
| [N/cm] | [861] | [875] |
| Strip Tensile Strength* | | |
| MD, Note 1 | 13.0 | 11.5 |
| [Note 2] | [0.67] | [0.59] |
| XD, Note 1 | 13.8 | 11.6 |
| [Note 2] | [0.71] | [0.60] |
| Alternate Extension Cycles | >100 | >200 |
| Jet Tracks | | |
| per inch | 20 | 20 |

TABLE I-continued

| | Fabrics of Example 1 | |
|---|---|---|
| | Batt 1-a | Batt 1-b |
| [per cm] | [7.87] | [7.87] |

*Footnotes:
1. Strip tensile strengths are in (lb/in)/(oz/yd$^2$)
2. Bracketted values of strip tensile strengths are in (N/cm)/(g/m$^2$).

EXAMPLE 2

This example further illustrates the invention with heavy-weight, nonapertured, jet-tracked nonwoven fabrics of hydraulically entangled staple fibers of poly(m-phenylene isophthalamide).

Two batts of Nomex® aramid staple fibers were prepared by an air-laydown process of the type described in Zafiroglu, U.S. Pat. No. 3,797,074. The Nomex® fibers were available commercially from E. I. du Pont de Nemours and Company and are made from poly(m-phenylene isophthalamide) polymer. Batt 2-a consisted essentially of a 67/33 blend of 1.5 inch [3.8 cm] long and ¼ inch [0.64 cm] long staple fibers of 2 denier [2.2 dtex]. Batt 2-b consisted essentially of 1 inch [2.5 cm] long fibers of 2 denier [2.2 dtex]. Batts 2a and 2b were treated with columnar hydraulic jets to form fabrics respectively weighing 7.0 and 8.6 oz/yd$^2$ [237 and 292 g/m$^2$]. Table II summarizes the sequence of jet treatments. The first five rows of jets impact one face of the batt; the other rows, the other face.

TABLE II

| Batt 2-a | | | Batt 2-b | | |
|---|---|---|---|---|---|
| Orifice Set | Support Screen | Pressure psi [kPa] | Orifice Set | Support Screen | Pressure psi [kPa] |
| C | C | 500 [3450] | B | C | 700 [4820] |
| D | C | 400 [2760] | B | C | 700 [4820] |
| C | C | 800 [5510] | A | A | 500 [3450] |
| C | C | 2000 [13780] | A | A | 500 [3450] |
| C | C | 2000 [13780] | C | A | 2000 [13780] |
| D | A | 800 [5510] | C | D | 600 [4130] |
| C | A | 1600 [11020] | C | D | 1100 [7580] |
| C | A | 2000 [13780] | C | D | 2000 [13780] |
| C | A | 2000 [13780] | C | D | 2000 [13780] |
| D | A | 2000 [13780] | | | |

The total ExI product and energy expended in the treatment of Batts 2-a and 2-b are summarized in Table III along with the characteristics of the resultant fabrics. The average strip tensile strength of the batts is plotted in the FIGURE and again shows the strength advantage of the fabrics of this example over similar prior art fabrics of the same weight.

TABLE III

| | Fabrics of Example 2 | |
|---|---|---|
| | Batt 2-a | Batt 2-b |
| Unit weight | | |
| oz/yd$^2$ | 7.0 | 8.6 |
| [g/m$^2$] | [237] | [292] |
| Energy-Impact Product | | |
| Hp-hr lb$_f$/lb$_m$ | 0.052 | 0.039 |
| [10$^6$ JN/kg] | [1.37] | [1.03] |
| Energy | | |
| Hp-hr/lb$_m$ | 0.65 | 0.46 |
| [10$^6$ J/kg] | [3.84] | [2.71] |
| Grab Strength | | |
| MD, lb/in | 118 | 119 |
| [N/cm] | [207] | [208] |
| XD, lb/in | 116 | 106 |
| [N/cm] | [203] | [186] |

TABLE III-continued

| | Fabrics of Example 2 | |
|---|---|---|
| | Batt 2-a | Batt 2-b |
| Strip Tensile Strength* | | |
| MD, Note 1 | 8.6 | 5.7 |
| [Note 2] | [0.44] | [0.29] |
| XD, Note 1 | 7.0 | 5.3 |
| [Note 2] | [0.36] | [0.27] |
| Alternate Extension Cycles | >119 | 51 |
| Jet tracks | | |
| per inch | 20 | 10 |
| [per cm] | [7.9] | [3.9] |

*Footnotes:
1. Strip tensile strengths are in (lb/in)/(oz/yd$^2$)
2. Bracketted values of strip tensile strengths are in (N/cm)/(g/m$^2$)

EXAMPLE 3

This example illustrates the production of fabrics of the invention from poly(ethylene terephthalate) staple fibers of 1.35 denier [1.5 dtex] and ¾ inch [1.9 cm] length. The fabrics exhibit excellent tensile characteristics and resistance to disentanglement. The four fabrics were prepared as described in the following paragraphs.

Batt 3-a was prepared on Rando-webber equipment and then treated sequentially by hydraulic jets from orifice set C while being forwarded at 10 yards/min [9.14 m/min] on screen support C. The batt was treated by seven rows of jets. The first four rows of jets treated one side of the batt and the remaining three rows the other side of the batt. The jet supply pressure was 200 psi [1380 kPa] for the first row of jets and 2800 psi [19,290 kPa] for the remaining rows of jets.

Batt 3-b was formed by means of an air-laydown apparatus of the type disclosed in Zafiroglu, U.S. Pat. No. 3,797,074 and then, while being forwarded at 10 yards/min [9.14 m/min], was treated sequentially by seven rows of jets. The first four rows treat one side of the batt; the last three rows treat the other side. While under the first row of jets, the batt is on support screen C; on screen A while under the next three rows; and on screen B while under the last three rows. The first row of jets was supplied through orifice set C at a pressure of 1000 psi [6890] kPa. The next three rows were supplied through orifice sets D respectively at pressures of 500, 1500 and 2000 psi [3450, 10,340 and 13,780 kPa]. The final three rows were supplied through orifice sets D respectively at pressures of 500, 1500 and 2000 psi [3450, 10,340 and 13,780 kPa].

Batts 3-c and 3-d were formed on a similar air laydown apparatus as used for Batt 3-b, but one that gave more MD direction strength to the batt. Batts 3-c and 3-d were subjected to rows of hydraulic jets while being forwarded at 13.6 yards/min [12.4 m/min]. For Batt 3-c, one face of the batt was subjected in sequence to one row of jets supplied through orifice set E at 1500 psi [10,340 kPa] while on screen support C, and then while on screen support B, to one row of jets supplied through orifice set C at 500 psi [3450 kPa] and 4 rows of jets supplied through orifice set D at 2000 psi [13,780 kPa]. Then, the other face of the batt was subjected while on screen support B, to the same sequence of rows of jets as the first face except that the very first row of jets was omitted. This treatment was repeated for Batt 3-d, except that the first row of jets was replaced by two rows of jets (which treated only the first face of the batt), the first being supplied at 1300 psi (8960 kPa) through orifice set B and the second, through orifice E at 500 psi [3450 kPa].

The total ExI product and the energy expended in forming the four batts into fabrics of the invention and the characteristics of the resultant fabrics are summarized in Table IV. The average strip tensile strengths, which are plotted in the FIGURE, clearly show the advantage of these heavy-weight fabrics of the invention over the comparable heavy-weight nonwoven fabrics of the prior art.

TABLE IV

| | Fabrics of Example 3 | | | |
|---|---|---|---|---|
| Batt | 3-a | 3-b | 3-c | 3-d |
| Unit Weight | | | | |
| oz/yd$^2$ | 21.3 | 11.0 | 7.8 | 8.2 |
| [gm/m$^2$] | [722] | [373] | [264] | [278] |
| ExI product | | | | |
| Hp-hr $lf_f/lb_m$ | 0.056 | 0.0124 | 0.0354 | 0.0337 |
| [$10^6$ JN/kg] | [1.47] | [0.33] | [0.93] | [0.89] |
| Energy | | | | |
| hp-hr/$lb_m$ | 0.41 | 0.29 | 0.71 | 0.71 |
| [$10^6$ J/kg] | [2.42] | [1.71] | [4.19] | [4.19] |
| Grab Strength | | | | |
| MD, lb/in | 357 | 231 | 156 | 167 |
| [N/cm] | [625] | [404] | [273] | [292] |
| XD, lb/in | 324 | 189 | 93 | 95 |
| [N/cm] | [567] | [331] | [163] | [166] |
| Strip Tensile* | | | | |
| MD | 8.3 | 8.9 | 11.6 | 9.5 |
| | [0.43] | [0.46] | [0.60] | [0.49] |
| XD | 7.7 | 7.4 | 4.6 | 4.0 |
| | [0.39] | [0.38] | [0.24] | [0.21] |
| Cycles** | >100 | >100 | 122 | 55 |
| Jet Tracks | | | | |
| per inch | 20 | 20 | 20 | 10 |
| [per cm] | [7.9] | [7.9] | [7.9] | [3.9] |

*See Table 1 footnotes for units of strip tensile strength.
**Alternate extension cycles

EXAMPLE 4

In this example staple fibers of polyethylene terephthalate of different deniers and of different lengths are blended together to form batts which are then treated with columnar streams of water to obtain strong, nonapertured, heavy-weight nonwoven fabrics of the present invention.

Three batts of blended polyester fibers were prepared by the same air-laydown process as used in Example 2. Two of the batts labelled 4-a and 4-b were made with a 50/50 blend of 1¼-inch [3.2 cm] long, 6-denier [6,7-dtex] fibers with ¼-inch [0.64-cm] long, 1.35-denier [1.5-dtex] fibers. The third batt, 4-c, contained a 67/33 blend respectively of these fibers. These batts were forwarded at 10 yards/min [9.14 m/min] through columnar water jets, supplied through orifice sets D while supported in sequence on Screens C, A and B. While on Screens C and A the jets entered through one surface of the batt, and while on Screen B, the jets entered through the opposite surface. The sequence of jet supply pressure was as given in Table V. The total ExI product and the energy expended in treating the three batts are listed in Table VI along with the characteristics of the resultant fabrics. The average strip tensile strength of the fabrics are plotted in the FIGURE. The data clearly show the advantage in tensile strength of these fabrics of the invention over similar prior art fabrics of the same weight.

TABLE V

| Batts 4-a & 4-b | | Batt 4-c | |
|---|---|---|---|
| Screen Support | Pressure psi [kPa] | Screen Support | Pressure psi [kPa] |
| C | 200 [1380] | C | 200 [1380] |
| A | 500 [3450] | A | 500 [3450] |
| A | 1800 [12400] | A | 1500 [10340] |
| A | 2000 [13780] | A | 1800 [12400] |
| B | 500 [3450] | A | 2000 [13780] |
| B | 1800 [12400] | A | 2000 [13780] |
| B | 2000 [13780] | B | 500 [3450] |
| | | B | 1500 [10340] |
| | | B | 1800 [12400] |
| | | B | 2000 [13780] |
| | | B | 2000 [13780] |

TABLE VI

| | Fabrics of Example 4 | | |
|---|---|---|---|
| Batt | 4a | 4b | 4c |
| Unit Weight | | | |
| oz/yd$^2$ | 9.1 | 7.3 | 8.9 |
| [g/m$^2$] | [308] | [247] | [302] |
| ExI Product | | | |
| Hp-hr $lb_f/lb_m$ | 0.018 | 0.022 | 0.033 |
| [$10^6$ JN/kg] | [0.47] | [0.58] | [0.87] |
| Energy | | | |
| Hp-hr/$lb_m$ | 0.39 | 0.49 | 0.73 |
| [$10^6$ J/kg] | [2.30] | [2.89] | [4.31] |
| Grab Strength | | | |
| MD, lb/in | 213 | 190 | 221 |
| [N/cm] | [373] | [333] | [387] |
| XD, lb/in | 195 | 159 | 184 |
| [N/cm] | [341] | [278] | [322] |
| Strip Tensile* | | | |
| MD | 10.8 | 11.2 | 9.9 |
| | [0.56] | [0.58] | [0.51] |
| XD | 8.7 | 9.7 | 8.4 |
| | [0.45] | [0.50] | [0.43] |
| Cycles** | 60 | 51 | 52 |
| Jet tracks | | | |
| per inch | 40 | 40 | 40 |
| [per cm] | [15.7] | [15.7] | [15.7] |

*See Table I footnote for units of strip tensile strength.
**Alternate extension cycles

EXAMPLE 5

This example illustrates the production of a nonwoven fabric of the invention from a 50/50 blend of 1.5-inch [3.8-cm] long, 15-denier [16.7-dtex] with ¼-inch [0.63-cm] long, 1.8-den [2-dtex] staple fibers of 66 nylon. The fiber blend was formed into a batt with an air laydown apparatus of the type disclosed in Zafiroglu, U.S. Pat. No. 3,797,074. The batt was then forwarded at 8.0 yards/min [7.3 meters/min] through rows of hydraulic jets, while supported on screens. The sequence of treatments was as follows:

| Orifice Set | Support Screen | Pressure psi [kPa] |
|---|---|---|
| C | C | 500 [3450] |
| D | B | 500 [3450] |
| D | B | 1500 [10340] |
| C | B | 2000 [13780] |
| D | E | 500 [3450] |
| D | E | 1500 [10340] |

-continued

| Orifice Set | Support Screen | Pressure psi [kPa] |
|---|---|---|
| C | E | 2000 [13780] |

While the batt was on screens C and B, the jets impinged on one surface of the batt and then while the batt was on screen E, the jets impinged on the other surface of the batt. As a result of the treatment a strong, disentanglement resistant, heavy weight, nonapertured nonwoven fabric was formed whose characteristics are summarized in Table VII. As shown by the plot of average strip tensile versus unit weight, the fabric is far superior in tensile strength to prior art.

TABLE VII

| Fabrics of Example 5 | |
|---|---|
| Unit Weight | |
| oz/yd$^2$ | 13 |
| [g/m$^2$] | [441] |
| Energy-Impact Product | |
| Hp-hr $lb_f/lb_m$ | 0.023 |
| [$10^6$ JN/kg] | [0.60] |
| Energy | |
| Hp-hr/$lb_m$ | 0.34 |
| [$10^6$ J/kg] | [2.01] |
| Grab Strength | |
| MD, lb/in | 240 |
| [N/cm] | [420] |
| XD, lb/in | 202 |
| [N/cm] | [354] |
| Strip Tensile Strength* | |
| MD, Note 1 | 8.3 |
| [Note 2] | [0.43] |
| XD, Note 1 | 5.7 |
| [Note 2] | [0.29] |
| Alternate Extension Cycles | 98 |
| Jet Tracks | |
| per inch | 20 |
| [per cm] | [7.9] |

Footnotes:
1. Strip tensile strengths are in (lb/in)/(oz/yd$^2$)
2. Bracketted values of strip tensile strengths are in (N/cm)/(g/m$^2$)

What is claimed is:

1. An improved heavy-weight, nonapertured, jet tracked nonwoven fabric consisting essentially of hydraulically entangled staple fibers of synthetic organic polymer, the improvement comprising the fabric having in combination a unit weight in the range of 200 to 850 g/m$^2$, a grab strength of at least 160 N/cm, a strip tensile strength of at least 0.26 (N/cm)/(g/m$^2$) and a resistance to disentanglement of at least 50 alternate extension cycles, said fabric not having been subjected to a shrinking operation.

2. A nonwoven fabric of claim 1 wherein the unit weight is in the range of 240 to 510 g/m$^2$, the grab strength is in the range of 245 to 875 N/cm, the strip tensile strength is in the range of 0.36 to 0.77 (N/cm)/(g/m$^2$), the resistance to disentanglement is at least 90 alternate extension cycles and the fabric has between 3 and 10 jet tracks per cm.

3. A nonwoven fabric of claim 1 wherein the staple fibers are of 1 to 18 dtex and of 0.6 to 5 cm length.

4. A nonwoven fabric of claim 1 or 2 wherein the polymer is poly(p-phenylene terephthalamide).

5. A nonwoven fabric of claim 1 or 2 wherein the polymer is poly(m-phenylene isophthalamide).

6. A nonwoven fabric of claim 1 or 2 wherein the polymer is poly(ethylene terephthalate).

* * * * *